United States Patent [19]

Baker

[11] 4,122,560

[45] Oct. 31, 1978

[54] QUICKLY TENSIONED DIVIDER LINE FOR SWIMMING POOLS

[76] Inventor: William H. Baker, 30 Honeysuckle Woods, Clover, S.C. 29710

[21] Appl. No.: 804,473

[22] Filed: Jun. 7, 1977

[51] Int. Cl.[2] ..... E04H 3/18

[52] U.S. Cl. ..... 4/172; 24/71 ST; 24/71.1

[58] Field of Search ..... 4/172, 172.11; 24/71 CT, 71 T, 71 A, 71 ST, 71 TT, 71 TD, 71.1, 71.2, 68 R

[56] References Cited

U.S. PATENT DOCUMENTS

| | | | |
|---|---|---|---|
| 257,263 | 5/1882 | Wood | 24/71 TD |
| 696,574 | 4/1902 | Laros | 24/71 ST |
| 2,335,000 | 11/1943 | Edwards | 24/71.1 |
| 3,755,829 | 9/1973 | Walklet | 4/172 |

FOREIGN PATENT DOCUMENTS

| | | | |
|---|---|---|---|
| 310,578 | 8/1933 | Italy | 24/71.1 |

*Primary Examiner*—Richard E. Aegerter
*Assistant Examiner*—L. Footland

[57] ABSTRACT

A quickly tensioned divider line for swimming pools is provided, comprising, in combination, a first divider line adapted for attachment to a first fixed location in a swimming pool; and a tensioning toggle attached to the line, and adapted for attachment to a second fixed location in a swimming pool, optionally, via a second divider line, the first and any second line thereby being located with the toggle in a divider line position in the pool; the toggle having first and second toggle arms, the first toggle arm being pivotably mounted on the second toggle arm, and movable between retracted and extended positions, in the retracted position being axially coextensive over at least a part of its length with respect to the second arm, and in the second position being axially extended over at least a part of its length with respect to the second arm; attaching means pivotably mounted on the first toggle arm, for movement therewith between its retracted and extended positions; and attaching means on the second toggle arm; the first toggle arm in the retracted position putting the first divider line attached to one of the toggle attaching means under relative tension, and in the extended position putting the first divider line attached to one of the toggle attaching means under relative slack.

10 Claims, 6 Drawing Figures

QUICKLY TENSIONED DIVIDER LINE FOR SWIMMING POOLS

Racing lines are commonly used in swimming pools for competition events, to divide the pool surface into racing lanes. Similar lines can be used for dividing the pool into different portions for different types of pool activity, restricting bathers to those portions of the pool reserved for a designated activity. They may also be used to prevent poor swimmers from venturing into too deep water, particularly in rather large pools.

For use as a dividing line, the line must be relatively taut; a slack line will shift position in turbulent water, and under windy conditions. It is however desirable from time to time to detach and remove the line, or replace the line, or floats carried on the line. For this purpose, it is necessary to let the line go slack. Since the line is held by anchors between fixed locations on opposite walls of the pool, and/or between posts embedded in the pool bottom, slackening a taut line can be a time-consuming and inconvenient procedure, particularly when the anchors are eyebolts screwed into a socket, as is usually the case.

In accordance with the invention, a quickly tensioned divider line for swimming pools is provided comprising, in combination, a first divider line adapted for attachment to a first fixed location in a swimming pool; and a tensioning toggle attached to the line, and adapted for attachment to a second fixed location in a swimming pool, the line thereby being located in a divider line position in the pool; the toggle having first and second toggle arms, the first toggle arm being pivotably mounted on the second toggle arm, and movable between retracted and extended positions, in the retracted position being axially coextensive over at least a part of its length with respect to the second arm, and in the second position being axially extended over at least a part of its length, with respect to the second arm; attaching means pivotably mounted on the first toggle arm, for movement therewith between its retracted and extended positions; and attaching means on the second toggle arm; the first toggle arm in the retracted position putting a divider line attached to one of the attaching means under relative tension and the extended position putting a divider line attached to one of the attaching means under relative slack.

A preferred embodiment of the invention is illustrated in the drawings, in which.

Figure 1:
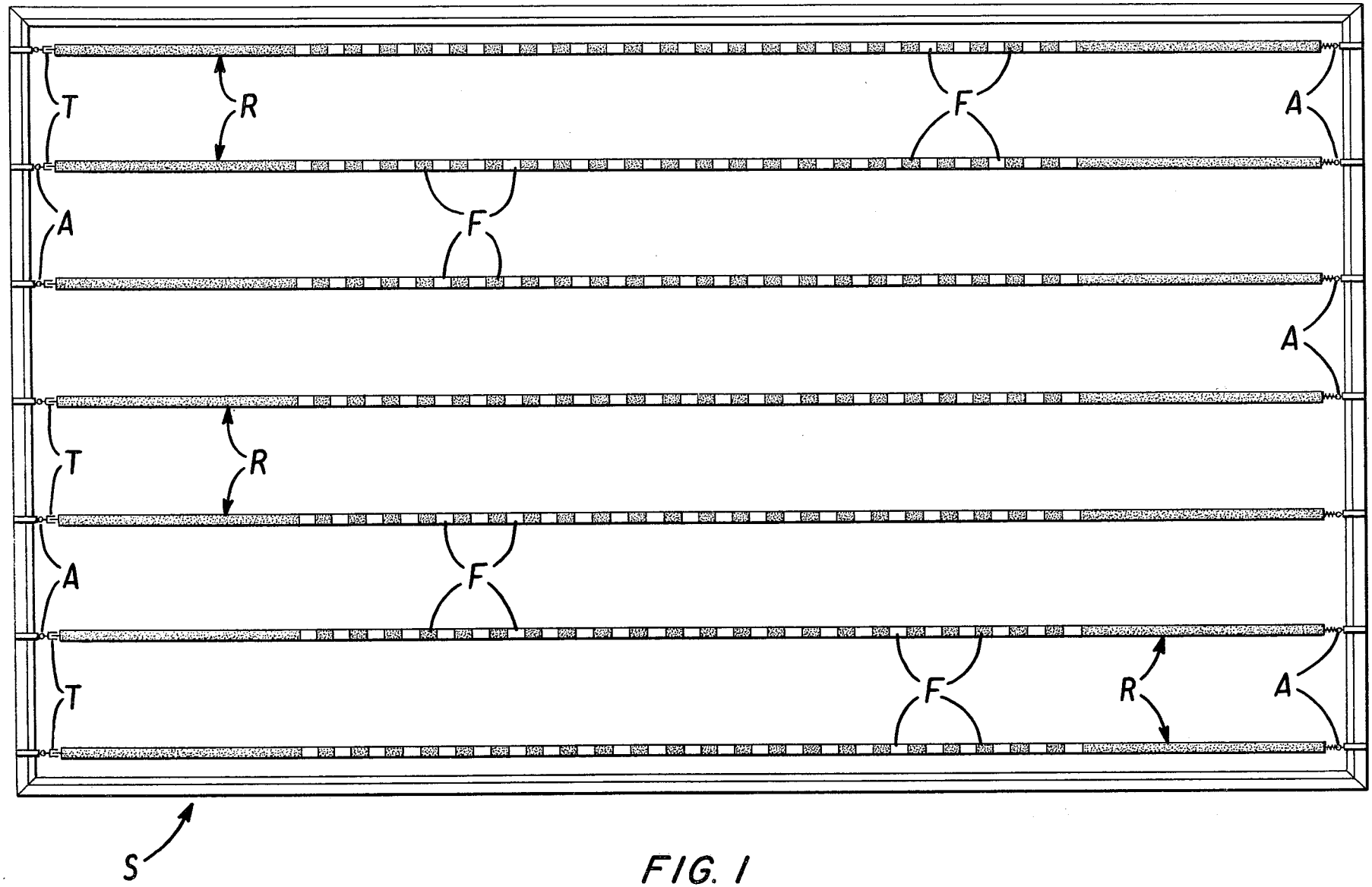
FIG. 1 represents a top view of a swimming pool carrying a plurality of divider lines in accordance with the invention, extending from wall to wall in parallel, longitudinally of the length of the pool.

The swimming pool S of FIG. 1 has a plurality, in this case seven, of racing lines R, each carrying a number of floats F. Each line R is fixed at each end to the anchors A on the wall of the swimming pool, with the toggle T as an intermediary at one end.

Figure 3:
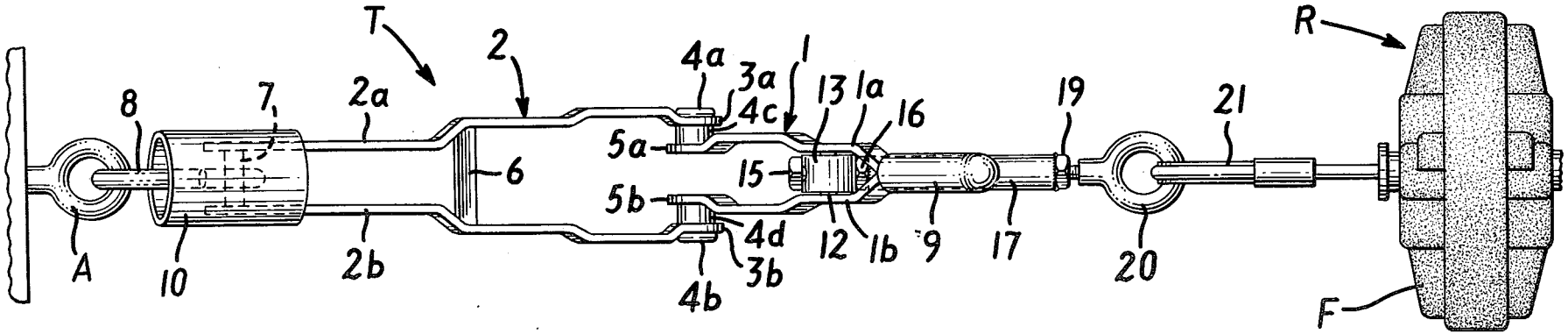
FIG. 3 is a top detail view of the extended toggle and a portion of the attached divider line of FIG. 2.
Figure 4:
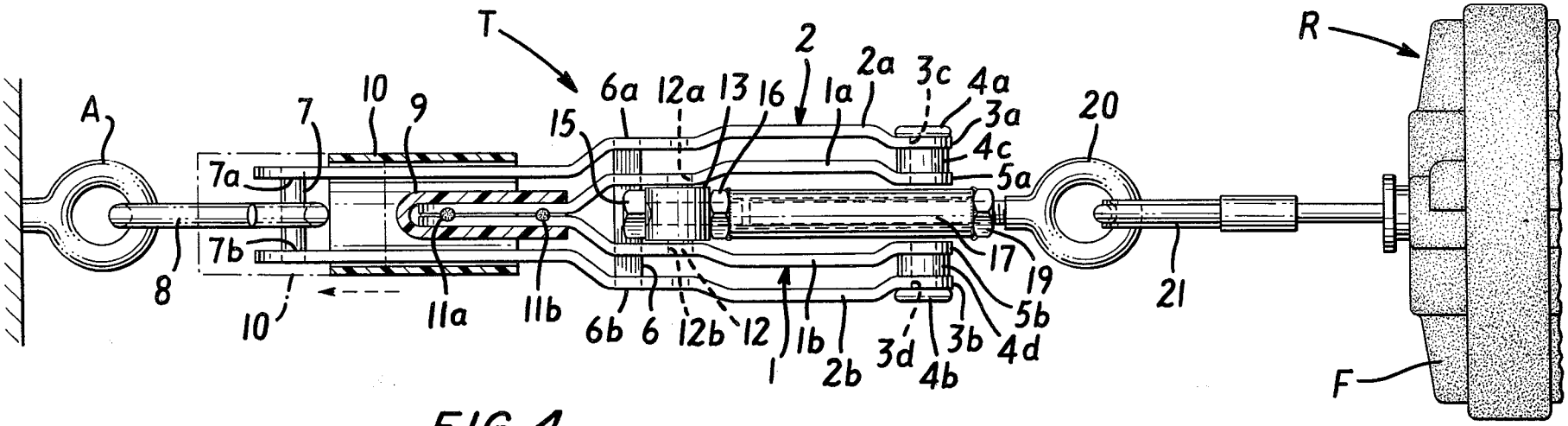
FIG. 4 is a top detail view of the retracted toggle and attached divider line of FIG. 2.
Figure 5:
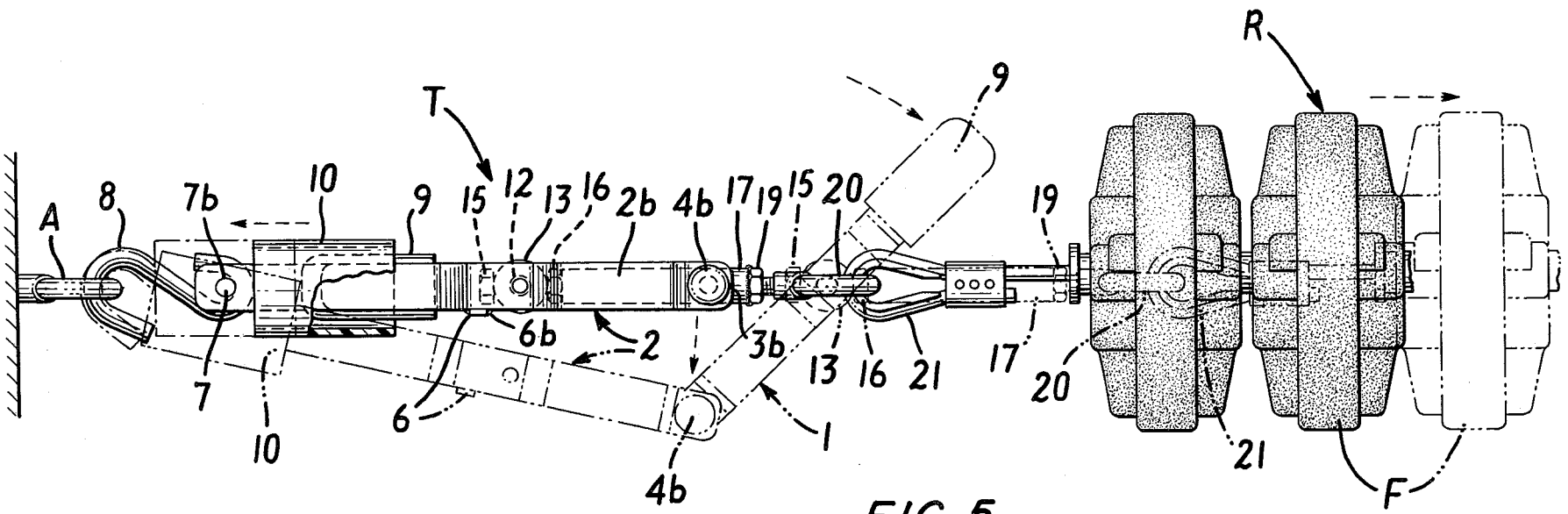
FIG. 5 is a side detail view of the retracted toggle and divider line of FIG. 2, showing the extended position in broken lines.
Figure 6:
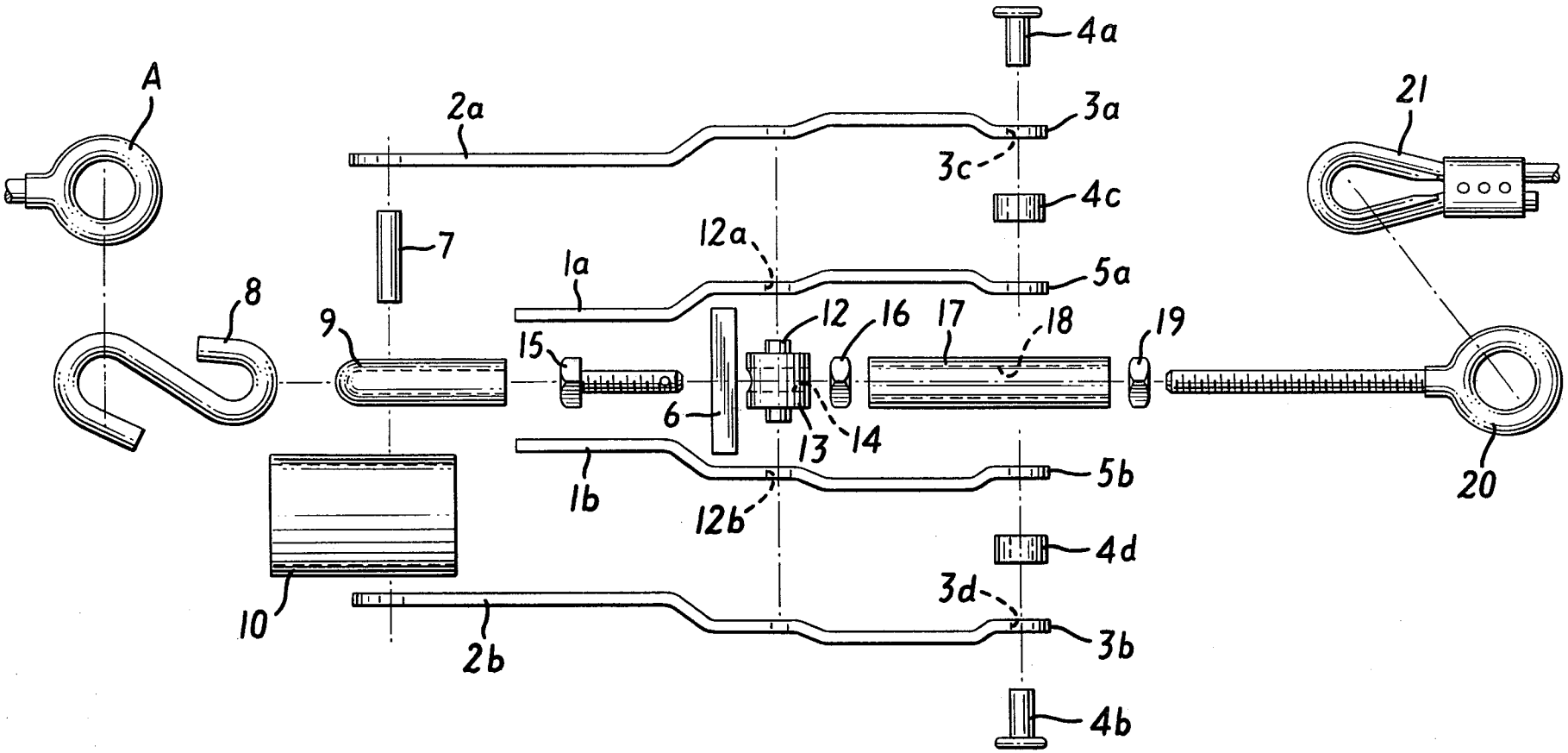
FIG. 6 is an exploded view of the line and toggle and toggle-to-line and toggle-to-wall attachments of FIG. 4.

As shown in detail in FIGS. 3, 4, and 5, the toggle T is composed of a first inner toggle arm 1 and a second outer toggle arm 2. The toggle arm 2 is bifurcated, with opposed spaced arm portions 2*a* and 2*b*. Each arm portion at one end 3*a*, 3*b* is apertured at 3*c*, 3*d*, and each aperture carries a pivot pin or rivet 4*a*, 4*b*. The first toggle arm 1 is also bifurcated, with arm portions 1*a*, 1*b*, and is pivotably mounted at its bifurcated ends, 5*a*, 5*b* on the pivot pin rivets 4*a*, 4*b*. The spacers 4*c*, 4*d* locate and space the first and second toggle arms 1*a*, 1*b*, 2*a*, 2*b* on the pins 4*a*, 4*b*. The first toggle arm 1 can thus pivot on the pins 4*a*, 4*b* between two limiting positions, the retracted position shown in FIG. 4, and the extended position shown in FIG. 3.

In the retracted position, the portions 1*a*, 1*b* of inner toggle arm 1 are nested between and coextensive with the arm portions 2*a*, 2*b* of the toggle arm 2. In the dashed line position, the toggle arm 1 is extended with respect to toggle arm 2, with the end formerly in the nested position extending axially when in the extended position, thus lengthening the toggle by a length nearly equal to the entire length of the first toggle arm.

The two arm portions 2*a* and 2*b* of the second toggle arm 2 are linked together by a first cross bar 6, which is fuse-welded at each end 6*a*, 6*b* to the arm portions 2*a* and 2*b*, and by a second cross bar 7, also fuse-welded at each end 7*a*, 7*b* to the arm portions 2*a*, 2*b*. The second cross bar 7 carries a hook 8, which can be attached to a racing or dividing line, or to a fixed location in the wall or on a post of a swimming pool.

The first toggle arm portions 1*a*, 1*b* are spot welded together at one end at two places, 11*a* and 11*b*, and the end is sheathed in handle 9. A keeper 10, which is tubular and of plastic material, slides along the portions 2*a*, 2*b* of the second toggle arm, over the handle portion 9 of the first toggle arm 1, and when in the position shown in solid lines in FIGS. 4 and 5 retains it in the nested position. However, when the sleeve 10 is moved along the toggle arm to the dashed line position shown in FIGS. 4 and 5, it is possible to swing the handle 9 and the first toggle arm 1 outwardly, away from the retracted and nested position, and into the extended position.

The first toggle arm portions 1*a*, 1*b* at their midpoints carry a pivot pin 12, whose ends are rotatably carried in sockets 12*a*, 12*b* in arm portions 1*a* and 1*b*. On the pivot pin 12 is mounted a pivot bushing 13, with a central transverse passage 14, through which loosely passes the cap screw 15, which threads through the nut 16, fuse-welded to tube 17, on the other side of the bushing. Any portion of the screw 15 extending beyond the nut 16 can be stored in the central passage 18 of the tube 17, to which the nut is fuse-welded.

At the other end of the tube 17 is fuse-welded a second nut 19, into which threads the eyebolt 20, adapted to carry a racing or dividing line 21, such as a stainless steel wire cable. The eyebolt when threaded into the nut 19 can project for any desired distance into the passage 18 of the tube, according to the tension required on the line, when the first toggle arm 1 is in the position shown in FIG. 4.

Figure 2:
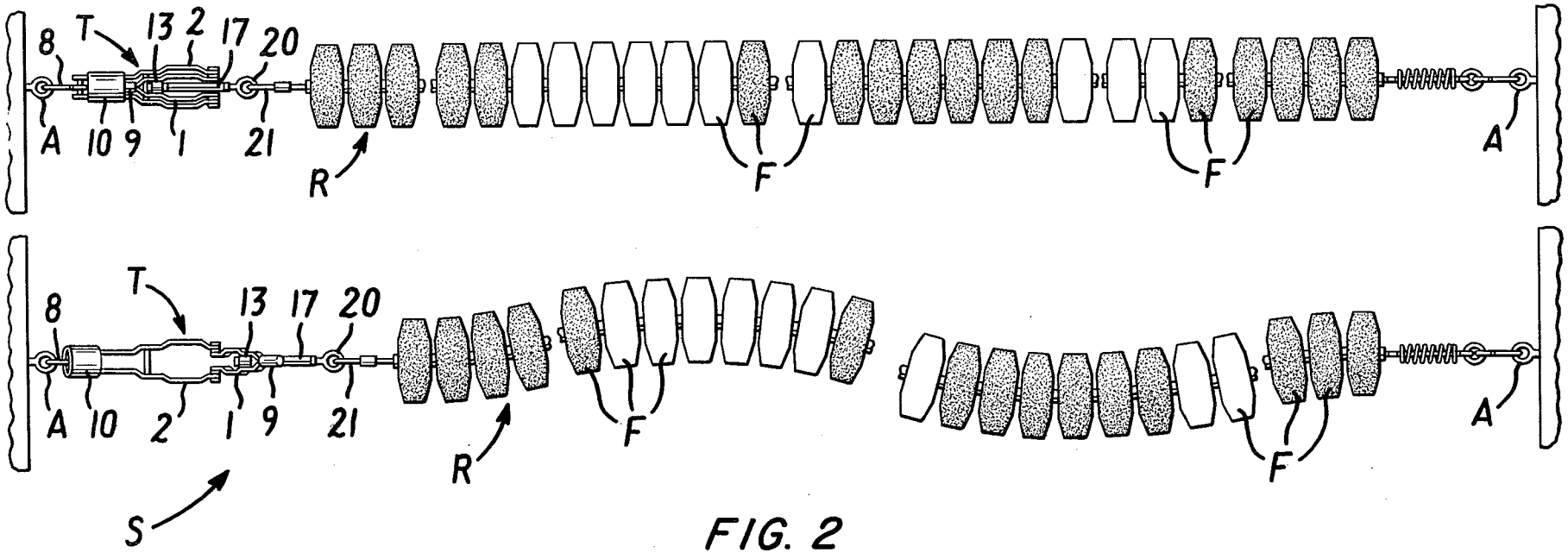
FIG. 2 is a top view on a larger scale, showing two of the toggles and divider lines attached of FIG. 1, with one retracted and one extended, with their divider lines taut and relaxed, respectively.

It will now be evident that if the handle sleeve 10 is pushed to the left, so as to release the handle 9 at the end of the first toggle arm 1, the arm can be swung out and around on pins 4*a*, 4*b* so that it now is in the extended dashed line position shown in FIG. 5, in which event the divider line 21 attached to the eyebolt 20 goes slack, as shown in FIG. 2. Thus, the divider line can be moved from a relatively taut to a relatively slack condition, simply by swinging movement of the first toggle arm 1 through an arc about pins 4*a*, 4*b*.

The toggle can be made of plastic or metal components, or any combination thereof. For use in a swimming pool, the materials will be selected for corrosion resistance. Thus, for metal parts, stainless steel is preferred, but coated metals, such as coated iron, chromium alloys, nickel alloys, zinc-plated metals and bronze can be used. Also useful are plastics, such as polytetrachloroethylene, polyamides, polyesters, polycarbonates, polypropylene, polyethylene, phenol formaldehyde, urea-formaldehyde, and similar plastic materials.

While the embodiment shown in the drawings has the first and second toggle arms doubled, with the one toggle arm nested between the other toggle arms, in an in-line or straight position, when the toggle is drawn in, it is also possible to have single toggle arms, also in-line or straight when the toggle is drawn in.

It is also possible to have the toggle arms offset with respect to each other. An offset arrangement is particularly suitable when, instead of being nested within the second toggle arms, the first toggle arms are arranged externally of the second, or when single toggle arms are used instead of double arms. In the offset design, the first toggle arm cannot move into the in-line position when in the retracted position shown in FIG. 4, because the second toggle arm is in the way.

The straight or in-line position has the advantage, however, that there is no torque tending to open the toggle when the line is subjected to a sudden stress or shock, such as in the event of swimmers colliding with it, since the toggle is in a neutral position, and there is no force component tending to swing the toggle arm out, into the extended position. On the other hand, the offset position affords easier handling and more leverage in moving the toggle between extended and retracted positions.

Having regard to the foregoing disclosure, the following is claimed as the inventive and patentable embodiments thereof:

1. A swimming pool having the pool surface divided into lanes by a plurality of divider lines, comprising, in combination, a swimming pool having at least two opposite sides between which the divider lines extend; a plurality of means along each side for fixedly attaching the divider lines to fixed locations along said sides; and a plurality of quickly tensioned divider lines attached to said means along each side; the divider lines comprising, in combination, a first divider line section adapted for attachment to a first fixed location in a swimming pool; and a tensioning toggle attached to the line section and adapted for attachment to a second fixed location in a swimming pool, the line thereby being located in a divider line position in the pool; the toggle having a bifurcated inner first and second bifurcated outer toggle arms, the first toggle arm being pivotably mounted on the second toggle arm, and movable between retracted and extended positions, in the retracted position being axially coextensive over at least a part of its length with respect to the second toggle arm, and in the extended position being axially extended over at least a part of its length with respect to the second toggle arm; said first toggle arm having a pivot pin linking two portions of said first bifurcated toggle arm, and having first attaching means linked to the pivot pin for pivoting movement therewith with respect to the first toggle arm and nested between the bifurcated inner first toggle arm in the retracted position thereof; and second attaching means on the second toggle arm; the first toggle arm in the retracted position putting a divider line attached to one of the attaching means under relative tension, and in the extended position putting a divider line attached to one of the attaching means under relative slack; and means movable between positions retaining the first toggle arm in the retracted position and releasing the toggle arm from the retracted position to permit it to enter the extended position.

2. A quickly tensioned divider line for swimming pools according to claim 1 in which one of the attaching means of the toggle is attached to a divider line, and the other is adapted for direct attachment to a second fixed location in a swimming pool.

3. A quickly tensioned divider line for swimming pools according to claim 1 in which one of the attaching means of the toggle is attached to a divider line section, and the other is adapted for attachment via a second divider line section to a second fixed location in a swimming pool.

4. A quickly tensioned divider line for swimming pools according to claim 1 each bifurcated portion of the first toggle arm is pivotably mounted to a bifurcated portion of the second toggle arm.

5. A quickly tensioned divider line for swimming pools according to claim 1 in which the first toggle arm in the retracted position is nested between the bifurcated portions of the second toggle arm.

6. A quickly tensioned divider line for swimming pools according to claim 1 in which at least one of the first and second attaching means is axially adjustable to take up slack in a divider line attached thereto.

7. A quickly tensioned divider line for swimming pools according to claim 1, in which the tensioning toggle has means for attachment to a divider line or to a fixed location in a swimming pool that is axially adjustable to take up slack in a divider line attached to the toggle.

8. A quickly tensioned divider line for swimming pools according to claim 1 in which the movable means is a slide retainer on the second toggle arm sliding into a position over a portion of the first toggle arm and retaining it in the retracted position.

9. A quickly tensioned divider line for swimming pools according to claim 1 in which the first toggle arm when in the retracted position is in alignment axially with the second toggle arm.

10. A quickly tensioned divider line for swimming pools according to claim 1 in which the first toggle arm when in the retracted position is offset axially with respect to the second toggle arm.

* * * * *

UNITED STATES PATENT OFFICE

CERTIFICATE OF CORRECTION

Patent No. 4,122,560 Dated October 31, 1978

Inventor(s) William H. Baker

It is certified that error appears in the above-identified patent and that said Letters Patent are hereby corrected as shown below:

Column 3, line 60 : "bifurcated inner first" should be --first bifurcated inner--

Signed and Sealed this

*Eighteenth* Day of *September 1979*

[SEAL]

*Attest:*

*Attesting Officer*

LUTRELLE F. PARKER

*Acting Commissioner of Patents and Trademarks*